US007485033B2

(12) United States Patent
Baehr et al.

(10) Patent No.: US 7,485,033 B2
(45) Date of Patent: Feb. 3, 2009

(54) SYSTEM COMPRISING AN EXHAUST HOOD AND A SUPPORT FOR WALL OR CEILING MOUNTING OF THE EXHAUST HOOD

(75) Inventors: Thomas Baehr, Sundern (DE); Ingo Huester, Arnsberg (DE); Michael Ricke, Arnsberg (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 11/619,228

(22) Filed: Jan. 3, 2007

(65) Prior Publication Data

US 2007/0155299 A1 Jul. 5, 2007

(30) Foreign Application Priority Data

Jan. 4, 2006 (DE) ..... 10 2006 000 899

(51) Int. Cl.
*F24C 15/20* (2006.01)
*B08B 15/02* (2006.01)

(52) U.S. Cl. ..... 454/67; 454/49; 126/299 R

(58) Field of Classification Search ..... 454/56, 454/66, 67, 49; 285/19, 20, 24; 126/299 R
See application file for complete search history.

(56) References Cited

U.S. PATENT DOCUMENTS 1,695,645 A * 12/1928 Farley ..... 126/314
2,488,816 A * 11/1949 Heaton ..... 285/61
2,602,678 A * 7/1952 Mahoff et al. ..... 285/408
2,628,799 A * 2/1953 Aaby ..... 248/57
3,015,501 A * 1/1962 Minella ..... 285/58
3,618,959 A * 11/1971 Gerard ..... 277/301
4,011,803 A * 3/1977 Pfaffinger ..... 126/299 R
6,354,287 B1 * 3/2002 Kudoh ..... 126/299 R

FOREIGN PATENT DOCUMENTS

DE 198 37 412 2/2000
EP 0 982 547 3/2000
JP 09145114 A * 6/1997

* cited by examiner

*Primary Examiner*—Steven B McAllister
*Assistant Examiner*—Patrick F. O'Reilly, III
(74) *Attorney, Agent, or Firm*—Darby & Darby

(57) ABSTRACT

A system includes an exhaust hood having a housing and an exhaust conduit disposed on the housing, a support for mounting the exhaust hood to a wall or ceiling, and an exhaust duct extending in the wall or ceiling. The exhaust conduit has a first coupling member disposed on a holder so as to hold the first coupling member on the housing. The exhaust duct includes a second coupling member. At least one of the first and second coupling members has an aligning device for automatically aligning the coupling members with each other when bringing the system into a mounted condition. The first coupling member is disposed relative to the holder and the second coupling member is disposed relative to the support so as to each be movable in a direction substantially perpendicular to the coupling direction.

14 Claims, 2 Drawing Sheets

SYSTEM COMPRISING AN EXHAUST HOOD AND A SUPPORT FOR WALL OR CEILING MOUNTING OF THE EXHAUST HOOD

Priority is claimed to German patent application DE 10 2006 000 899.5, filed Jan. 4, 2006, which is hereby incorporated by reference herein.

The present invention relates to a system including an exhaust hood having a housing and an exhaust conduit mounted on the housing, and further including a support for wall or ceiling mounting of the exhaust hood, the exhaust conduit having a first coupling member which is held to the housing on a holder, and which, when moving the system to the mounted condition, is automatically coupled in a fluid-conducting manner to a second coupling member of an exhaust duct extending in the wall or ceiling.

BACKGROUND

DE 198 37 412 A1 describes a system including an exhaust hood having a housing and an exhaust conduit mounted on the housing, and further including a support in the form of a box for wall mounting of the exhaust hood, the exhaust conduit having a first coupling member which is in the form of an exhaust connector and held to the housing on a holder, and which, when moving the system to the mounted condition, is automatically coupled in a fluid-conducting manner to a second coupling member of an exhaust duct extending in the wall, said second coupling member being in the form of a centering connector. The second coupling member includes a means in the form of a basket-like centering cone, said means automatically aligning the two coupling members with each other in the process.

SUMMARY

It is, therefore, an object of the present invention to provide a system which includes an exhaust hood having a housing and an exhaust conduit mounted on the housing, and further includes a support for wall or ceiling mounting of the exhaust hood, and which is easier to mount to a wall or ceiling.

The present invention provides a system including: an exhaust hood including a housing and an exhaust conduit disposed on the housing, the exhaust conduit including a first coupling member disposed on a holder so as to hold the first coupling member on the housing; a support configured to mount the exhaust hood to a wall or ceiling; and an exhaust duct extending in the wall or ceiling, the exhaust duct including a second coupling member. The first coupling member is configured, when bringing the system into a mounted condition, to automatically couple in a fluid-conducting manner with the second coupling member in a coupling direction. At least one of the first and second coupling members includes an aligning device configured to automatically align the coupling members with each other when bringing the system into the mounted condition. The first coupling member is disposed relative to the holder and the second coupling member is disposed relative to the support so as to each be movable in a direction substantially perpendicular to the coupling direction.

BRIEF DESCRIPTION OF THE DRAWINGS

An exemplary embodiment of the present invention is shown in the drawings in a schematic way and will be described in more detail below. In the drawings.

DETAILED DESCRIPTION

Figure 1:
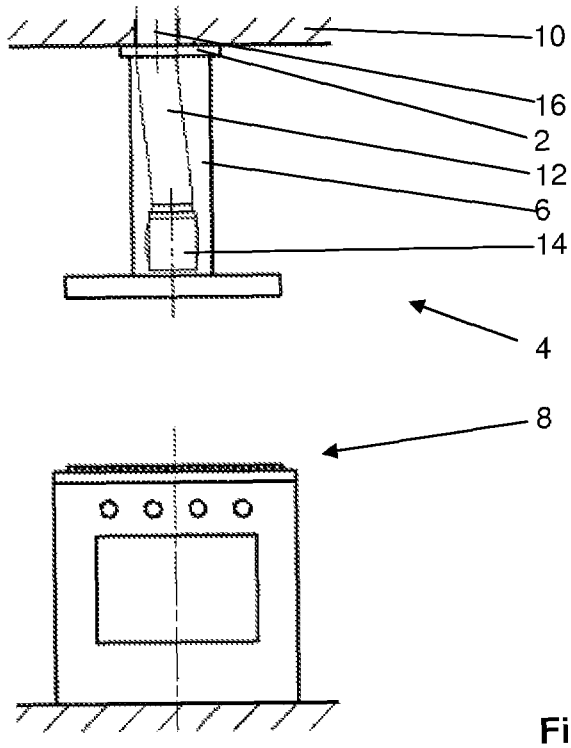
FIG. 1 is a front view of a system according to the present invention, showing the exhaust hood in the end position.

One particular advantage that can be achieved with the present invention is that it makes wall or ceiling mounting of the system easier. It is often a problem for the installer that the required alignment of the support on the wall or ceiling, and of the housing of the exhaust hood, deviates from the desired end position of the exhaust hood, for example, above a cooking area of a cooktop. This is remedied by the system according to the present invention. Moreover, the capability of simultaneous movement of the first coupling member relative to the holder and the second coupling member relative to the support provides increased play in a direction perpendicular to the coupling direction in order to compensate for the distance between the point where the exhaust duct penetrates the wall or ceiling and the desired mounting location of the exhaust hood on the wall or ceiling. This makes it possible to compensate for even greater tolerances within the same amount of space, as compared to the prior art.

In an advantageous refinement of the teaching according to the present invention, the first or the second coupling member includes a means in the form of a cone-like guide member. In this manner, the means is implemented in a structurally simple and rugged manner, while also increasing the functional reliability.

According to another advantageous refinement, the holder is in the form of a plate which, when the system is in the mounted condition, substantially closes the housing toward the wall or ceiling, except for an opening for the first coupling member. This effectively prevents access to the interior of the housing, and thus to electrical or moving parts.

In an advantageous refinement of the aforementioned embodiment, the first coupling member has wing-like retaining flaps which are spaced from each other in the coupling direction and overlap the plate when the system is in the mounted condition. Thus, the first coupling member is held to the plate in a structurally simple and rugged manner.

The aforementioned plate can, in principle, be selected within wide suitable limits in terms of dimensions and material. In an advantageous refinement, the first coupling member has a circular cross-section in the area of contact with the second coupling member, the opening in the plate is circular in cross-section, and the radius of the opening is equal to the sum of radius R of the first coupling member and a range of displacement VB calculated by the formula $VB=(K-2*R-A)/4$, where K is the shortest edge length of the plate and A is the overlap region of the wing-like retaining flaps and the plate, with A being about 5 mm. Thus, on the one hand, the first coupling member is securely held to the housing while at the same time allowing a high degree of compensation.

In a further refinement of the latter two embodiments, the support is designed as an additional plate, and a space is formed between the support and the wall or ceiling when the system is in the mounted condition, said space being engaged by the wing-like retaining flaps of the second coupling member. Thus, the second coupling member is held to the support in a structurally simple and rugged manner.

In FIG. 1, a system according to the present invention is shown in its mounted condition. The system includes a support 2 in the form of an additional plate, and an exhaust hood 4 which has a housing 6 in the form of a chimney housing and is attached to ceiling 10 above a cooking area 8 by means of support 2. FIG. 1 shows the system open toward the front, so that an exhaust conduit 12 extending in chimney housing 6 can be seen. Exhaust conduit 12 is connected in a fluid-conducting manner to an exhaust fan 14, which is also disposed in chimney housing 6, and to an exhaust duct 16 located in ceiling 10.

Figure 2:
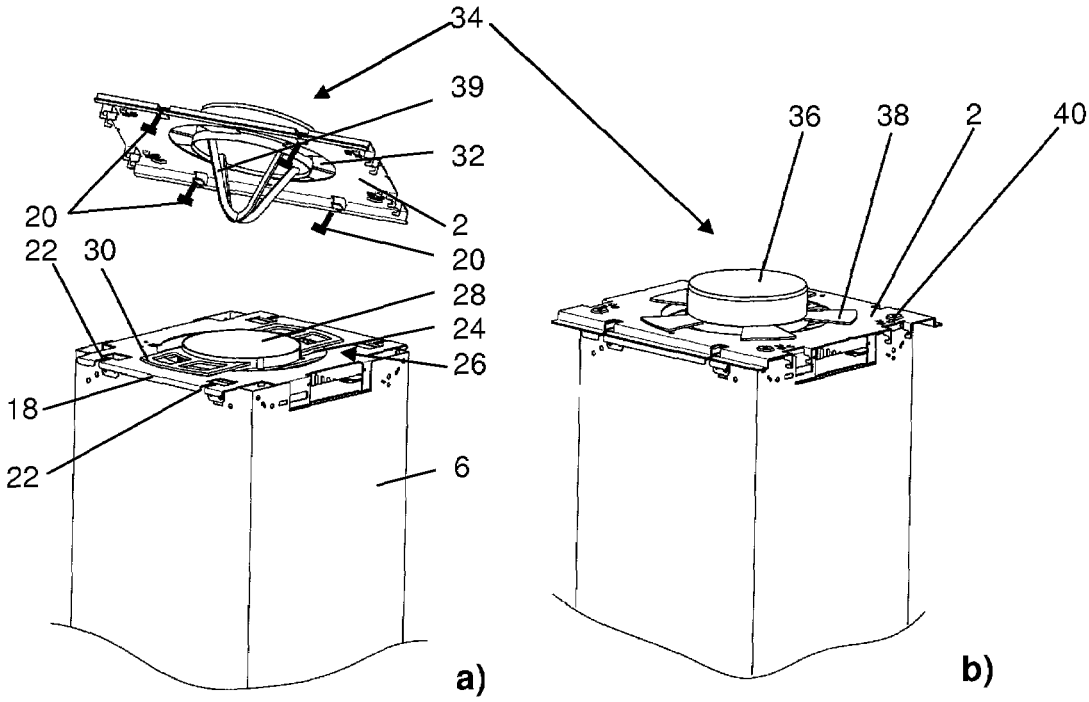
FIG. 2 is a partial perspective view showing the system of FIG. 1 in dismounted and mounted conditions.

In FIG. 2, exhaust hood 4 and support 2 are shown removed from ceiling 10, the dismounted condition being shown in FIG. 2*a*, and the mounted condition being shown in FIG. 2*b*.

In the mounted position, as can be seen from FIG. 2, a plate 18 disposed on chimney housing 6 holds exhaust hood 4 to support 2, which is designed as an additional plate. To this end, support 2 is provided with mounting bolts 20 which, when the system is in the mounted condition, engage mounting holes 22 of plate 18, the heads of said mounting bolts engaging under plate 18 when the system is in the mounted condition. Plate 18 closes chimney housing 6 upwardly towards support 2, except for a centrally located opening 24. When the system is in the mounted condition, a first coupling member 26 of exhaust conduit 12 is disposed in opening 24. First coupling member 26 is made of plastic and has a central tubular portion 28 having integrally formed therewith wing-like retaining flaps 30 which are disposed radially opposite one another, Wing-like retaining flaps 30, which are located on respective sides of tubular portion 28, are spaced from each other in the coupling direction such that they overlap plate 18 on both sides when the system is in the mounted condition. In FIG. 1, the coupling direction is symbolized by the dot-dash line and is upward in the image plane.

Support 2 also has a central opening 32 which is engaged by a second coupling member 34 of exhaust duct 16 when the system is in the mounted condition, the remainder of said second coupling member not being shown in FIG. 2.

As can clearly be seen from FIG. 2, second coupling member 34, which is made of plastic, also has a central tubular portion 36, which has integrally formed therewith wing-like retaining flaps 38 which extend radially outward in a star-like pattern. Also formed on the tubular portion 36 is a means 39 in the form of a cone-like guide member, said means automatically aligning the two coupling members 26 and 34 with each other when moving the system to a mounted condition, as will be explained in greater detail below. Here, cone-like guide member 39 is formed by four braces, so as to produce as little flow resistance as possible at the transition point from exhaust conduit 12 to exhaust duct 16.

When the system is in the mounted condition, support 2 is attached to ceiling 10 in a manner known to those skilled in the art, for example, by screw connections. Spacers 40 are formed on the side of support 2 that faces ceiling 10, so that, when the system is in the mounted condition, tubular portion 36 is, for the most part, located in an opening in ceiling 10, while retaining flaps 38 engage a space formed by spacers 40 between support 2 and ceiling 10. Due to this configuration, when the system is in the mounted condition, second coupling member 34 is secured in place in a direction parallel to the coupling direction, leaving a necessary amount of play, while it is movable in opening 32 in a direction perpendicular to the coupling direction.

Figure 3:
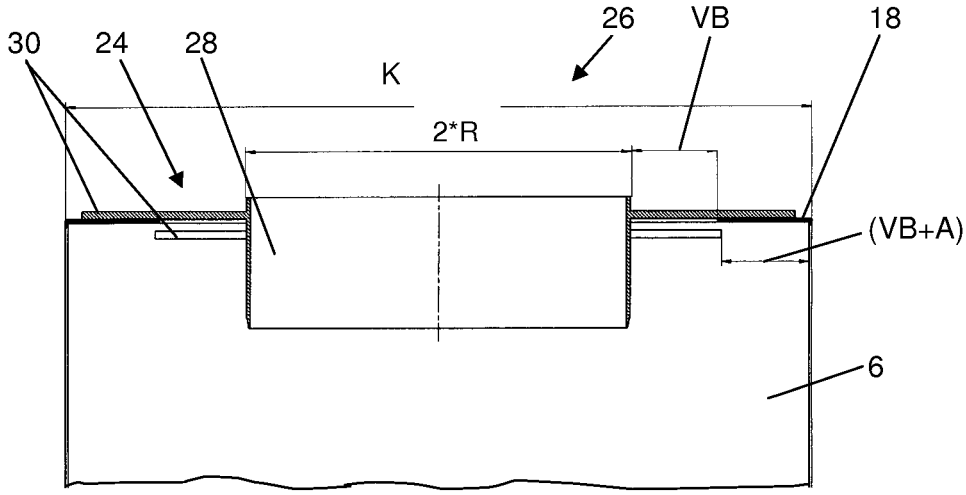
FIG. 3 is a partial cross-sectional front view of the upper portion of the housing of the exhaust hood.
Figure 4:
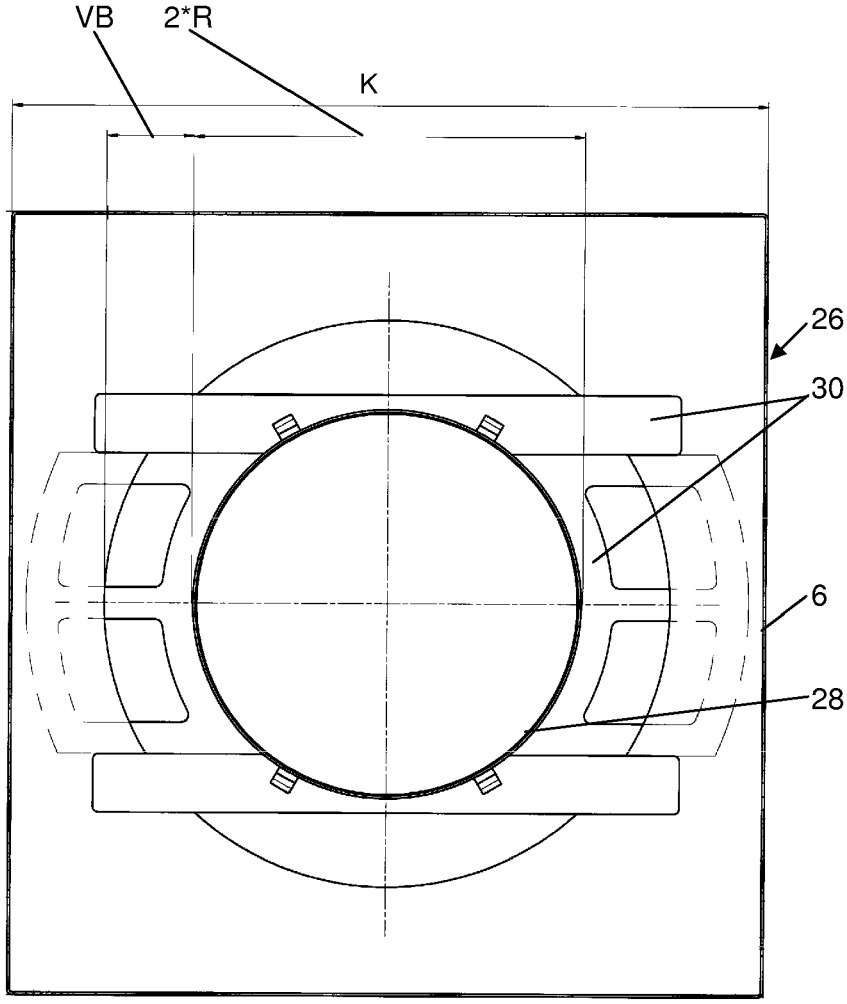
FIG. 4 is a bottom view of the housing of FIG. 3.

FIGS. 3 and 4 show the portion of chimney housing 6 that is at the top when the system is in the mounted condition. As can be clearly seen, first coupling member 26 overlaps plate 18 on both sides in the region of opening 24 with wing-like retaining flaps 30 formed on tubular portion 28, so that said first coupling member is secured in place in a direction parallel to the coupling direction, leaving a necessary amount of play, while it is movable in opening 24 in a direction perpendicular to the coupling direction.

In the present exemplary embodiment, the dimensions of opening 24 of plate 18 and the cross-section of first coupling member 26 in tubular portion 28 are matched to each other in such a way that, on the one hand, first coupling member 26 is securely held to plate-type holder 18 by wing-like retaining flaps 30 in all relative positions of first coupling member 26 with respect to plate 18. On the other hand, this allows a space-saving configuration. To this end, the range of displacement VB in millimeters is calculated by the formula $VB=(K-2*R-A)/4$, where K is the shortest edge length of the plate 18, R is the radius of first coupling member 26 in the area of contact with second coupling member 34, and A is the overlap region of wing-like retaining flaps 30 and plate 18, with A being about 5 mm.

The principle of operation will be explained in more detail below with reference to FIGS. 1 through 4.

As shown in FIG. 1, exhaust hood 4 is intended to be attached to ceiling 10 centrally above cooking area 8. In order to compensate for unavoidable deviations between the longitudinal axis of exhaust duct 16 located in ceiling 10 and the centerline of cooking area 8, which is symbolized as a dot-dash line in FIG. 1, the present invention proposes the following:

Initially, second coupling member 34 is connected in a fluid-conducting manner to the remainder of exhaust duct 16 in a manner known to those skilled in the art. Then, the additional plate 2 is attached to ceiling 10 in such a manner that second coupling member 34 protrudes through opening 32, as shown in FIG. 2.

Plate 18 is mounted to the chimney housing 6 of exhaust hood 4 as shown in FIG. 2 in a manner known to those skilled in the art. First coupling member 26 is inserted into opening 24 of plate 18, as can be seen in FIGS. 2 through 4. Since first coupling member 26, and thus also wing-like retaining flaps 30, are made of a resilient plastic, wing-like retaining flaps 30 can be easily deformed in the process, and then return to the normal condition illustrated in the Figures.

When moving the system to the mounted condition; i.e., when moving chimney housing 6 in the coupling direction toward support 2, cone-like guide member 39 automatically aligns the two coupling members 26 and 34 with each other and according to the desired end position of exhaust hood 4; i.e., centrally above cooking area 8. At the same time, first coupling member 26, and thus exhaust conduit 12, are automatically coupled to second coupling member 34, and thus to exhaust duct 16. Finally, the installer attaches exhaust hood 4 to support 2 using mounting holes 22 of plate 18 and mounting bolts 20 on support 2. In this manner, unavoidable deviations in the position of exhaust duct 16 in ceiling 10 with respect to its position required for the desired end position of exhaust hood 4 are effectively compensated for. The capability of simultaneous movement of first coupling member 26 relative to holder 18 and second coupling member 34 relative to support 2 provides improved compensation capabilities, so that even larger deviations can be compensated for.

The present invention is not limited to the exemplary embodiment described above. For example, the exhaust hood could also be attached to a wall. Moreover, the means for automatically aligning the two coupling members may also be mounted on the first coupling member. Furthermore, the fastening techniques and materials used can be selected within wide suitable limits.

What is claimed is:

1. A system comprising:

an exhaust hood including a housing and an exhaust conduit disposed on the housing, the exhaust conduit including a first coupling member disposed on a holder so as to hold the first coupling member on the housing;

a support configured to mount the exhaust hood to a wall or ceiling, the support providing substantially all of the support for the housing; and an exhaust duct extending in the wall or ceiling, the exhaust duct including a second coupling member;

wherein:

the first coupling member is configured, when bringing the system into a mounted condition, to couple in a fluid-conducting manner with the second coupling member in a coupling direction;

at least one of the first and second coupling members includes an aligning device configured to automatically align the coupling members with each other when bringing the system into the mounted condition;

the second coupling member is held to the support; and the first coupling member is disposed relative to the holder so as to provide a position adjustment of the first coupling member within the housing of the exhaust hood, and the second coupling member is disposed relative to the support so as to provide a position adjustment of the second coupling member within the support, where both coupling members are movable in a direction substantially perpendicular to the coupling direction with respect to at least one of the housing and the support.

2. The system as recited in claim 1 wherein the aligning device includes a cone-like guide member.

3. The system as recited in claim 2 wherein the holder includes a plate configured, when the system is in the mounted condition, to substantially close, except for an opening in the plate for the first coupling member, the housing toward the wall or ceiling.

4. The system as recited in claim 3 wherein the first coupling member includes a plurality of wing-like retaining flaps spaced from each other in the coupling direction and overlapping the plate when the system is in the mounted condition.

5. The system as recited in claim 4 wherein the first coupling member includes a circular cross-section in an area of contact with the second coupling member, the opening in the plate is circular in cross-section, and a radius of the opening is equal to a sum of a radius R of the first coupling member and a range of displacement VB, where $$VB=(K-2*R-A)/4$$

K being a shortest edge length of the plate, A being a length of a region of overlap of the wing-like retaining flaps and the plate, A being about 5 mm.

6. The system as recited in claim 5 wherein the support includes a second plate, a space formed between the second plate and the wall or ceiling being engaged by the wing-like retaining flaps of the second coupling member when the system is in the mounted condition.

7. The system as recited in claim 4 wherein the support includes a second plate, a space formed between the second plate and the wall or ceiling being engaged by the wing-like retaining flaps of the second coupling member when the system is in the mounted condition.

8. The system as recited in claim 1 wherein the holder has a form of a plate configured, when the system is in the mounted condition, to substantially close, except for an opening in the plate for the first coupling member, the housing toward the wall or ceiling.

9. The system as recited in claim 8 wherein the first coupling member includes a plurality of wing-like retaining flaps spaced from each other in the coupling direction and overlapping the plate when the system is in the mounted condition.

10. The system as recited in claim 9 wherein the first coupling member includes a circular cross-section in an area of contact with the second coupling member, the opening in the plate is circular in cross-section, and a radius of the opening is equal to a sum of a radius R of the first coupling member and a range of displacement VB, where $$VB=(K-2*R-A)/4$$

K being a shortest edge length of the plate, A being a length of a region of overlap of the wing-like retaining flaps and the plate, A being about 5 mm.

11. The system as recited in claim 10 wherein the support includes a second plate, a space formed between the second plate and the wall or ceiling being engaged by the wing-like retaining flaps of the second coupling member when the system is in the mounted condition.

12. The system as recited in claim 9 wherein the support includes a second plate, a space formed between the second plate and the wall or ceiling being engaged by the wing-like retaining flaps of the second coupling member when the system is in the mounted condition.

13. A system for coupling an exhaust conduit and exhaust duct in a coupling direction, the system comprising;

an exhaust hood including a housing and a holder disposed thereon;

an exhaust conduit disposed in the housing and including a first coupling member, the first coupling member being disposed contiguous to the holder and movable in a direction substantially perpendicular to the coupling direction with respect to the holder;

a support configured to mount the exhaust hood to a wall or ceiling; and an exhaust duct extending in the wall or ceiling and including a second coupling member, the second coupling member being disposed contiguous to the support and movable in a direction substantially perpendicular to the coupling direction with respect to the support;

wherein the first and second coupling members are configured to be coupled in a fluid-conducting manner and at least one of the first and second coupling members includes an aligning device configured to automatically align the coupling members as they are coupled.

14. The system as recited in claim 13 wherein movement of the first coupling member in the direction substantially perpendicular to the coupling direction with respect to the holder provides adjustment of the exhaust conduit in the housing.

* * * * *